US008475151B2

(12) United States Patent
Nemit, Jr. et al.

(10) Patent No.: US 8,475,151 B2
(45) Date of Patent: Jul. 2, 2013

(54) COMPRESSOR

(75) Inventors: Paul Nemit, Jr., Waynesboro, PA (US); Angela Marie Comstock, Roanoke, VA (US)

(73) Assignee: Johnson Controls Technology Company, Holland, MI (US)

( * ) Notice: Subject to any disclaimer, the term of this patent is extended or adjusted under 35 U.S.C. 154(b) by 628 days.

(21) Appl. No.: 12/748,285

(22) Filed: Mar. 26, 2010

(65) Prior Publication Data

US 2010/0247361 A1 Sep. 30, 2010

Related U.S. Application Data

(60) Provisional application No. 61/163,641, filed on Mar. 26, 2009.

(51) Int. Cl.
*F04C 18/16* (2006.01)

(52) U.S. Cl.
USPC ..... 418/201.1

(58) Field of Classification Search
USPC ..... 418/55.1, 69, 83, 201.1, 206.1; 417/269, 417/336; 123/573; 55/321; 29/888.022; 464/170, 177
See application file for complete search history.

(56) References Cited

U.S. PATENT DOCUMENTS

| | | | | |
|---|---|---|---|---|
| 2,596,640 | A * | 5/1952 | Berry | 418/9 |
| 3,558,248 | A * | 1/1971 | Parker | 418/88 |
| 3,796,526 | A * | 3/1974 | Cawley | 418/97 |
| 3,923,480 | A * | 12/1975 | Visch | 96/360 |
| 5,215,451 | A * | 6/1993 | Hara et al. | 418/55.1 |
| 5,312,234 | A * | 5/1994 | Yoshii | 418/55.1 |
| 5,954,476 | A * | 9/1999 | Stewart et al. | 415/214.1 |
| 6,494,688 | B1 * | 12/2002 | Barito et al. | 417/310 |
| 2002/0134062 | A1 * | 9/2002 | Strikis et al. | 55/462 |
| 2004/0247472 | A1 * | 12/2004 | Horton et al. | 417/902 |
| 2005/0025650 | A1 * | 2/2005 | Hsia | 418/55.1 |
| 2006/0159579 | A1 * | 7/2006 | Skinner et al. | 418/55.1 |
| 2007/0201996 | A1 * | 8/2007 | Gopinathan | 418/55.1 |

OTHER PUBLICATIONS

Bitzer International, Application Manual-Hermetic Compact Screws-VSK31-VSK 41, SH-300-1, Aug. 2008, 28 pages.

* cited by examiner

*Primary Examiner* — Kenneth Bomberg
*Assistant Examiner* — Jason T Newton
(74) *Attorney, Agent, or Firm* — McNees Wallace & Nurick LLC

(57) ABSTRACT

A compressor is provided with a substantially cylindrical housing. Inside the housing is a motor housing having a substantially cylindrical shape and a compressor housing having a substantially cylindrical shape. The motor housing and the compressor housing are connected or fit into the housing with a frictional connection to prevent axial movement of the motor housing and the compressor housing.

20 Claims, 12 Drawing Sheets

COMPRESSOR

CROSS-REFERENCE TO RELATED APPLICATIONS

This application claims priority from and the benefit of U.S. Provisional Application No. 61/163,641, entitled COMPRESSOR, filed Mar. 26, 2009 which is hereby incorporated by reference.

BACKGROUND

The application generally relates to screw compressors. The application relates more specifically to a screw compressor with the motor, compression mechanism and oil separator contained in a single housing.

In many screw compressor systems, the rotors of the compressor are contained in a rotor housing and are driven by a motor contained in a separate motor housing. The motor may be powered by a variable speed drive to provide variable capacity capabilities to the compressor. The output of the compressor is then sent to a oil separator that is in a separate vessel or housing from the motor housing and the compressor housing. The use of multiple housings requires precision manufacturing, for example, separate housing castings, and assembly and numerous seals to prevent fluid leaking from the system. In addition, the use of separate housings involves additional support and alignment features to maintain the proper orientation for the system.

Therefore, what is needed is a screw compressor system that can be easily assembled and does not require precision manufacturing of housing components.

SUMMARY

The present invention is directed to a compressor that includes a first housing, a second housing positioned in the first housing, and a third housing positioned in the first housing. A motor is positioned in the second housing and a compression mechanism is positioned in the third housing. The second housing is connected to the third housing to prevent relative rotational movement between the second housing and the third housing.

The present invention is also directed to a screw compressor with a substantially cylindrical housing. A motor housing is positioned in the housing and the motor housing has a substantially cylindrical shape. A motor is positioned in the motor housing. A compressor housing is positioned in the housing and the compressor housing having a substantially cylindrical shape. A pair of intermeshing rotors are positioned in the compressor housing. The motor housing and the compressor housing are connected to the housing with a frictional connection to prevent axial movement of the motor housing and the compressor housing in the housing.

The present invention is further directed to a method of assembling a compressor. The method includes expanding a diameter of a cylinder and inserting a compressor housing and a motor housing into the cylinder. The method also includes interlocking the compressor housing and motor housing to prevent relative rotational movement between the compressor housing and the motor housing and contracting the diameter of the cylinder to secure the compressor housing and motor housing in the cylinder with an interference connection. The method further includes inserting an oil separator into the cylinder and sealing the cylinder with the compressor housing, the motor housing and the oil separator.

One advantage of the application is a decreased cost of production resulting from the reduction or elimination of individual sealed housings for the motor housing and the compressor housing.

Another advantage of the application is a reduced risk of leaks from a reduction of the number of seals as a result of the reduction or elimination of individual sealed housings.

Still another advantage of the application is the compressor may be reduced in size by reducing or eliminating welds or other bulky fastening or securing mechanisms to connected the motor housing and the compressor housing.

A further advantage of the application is decreased costs associated with materials and/or transportation for the compressor as a result of decreased size.

Yet another advantage of the application is that the compressor can be manufactured and assembled using automated processes.

DETAILED DESCRIPTION OF THE EXEMPLARY EMBODIMENTS

Figure 1:
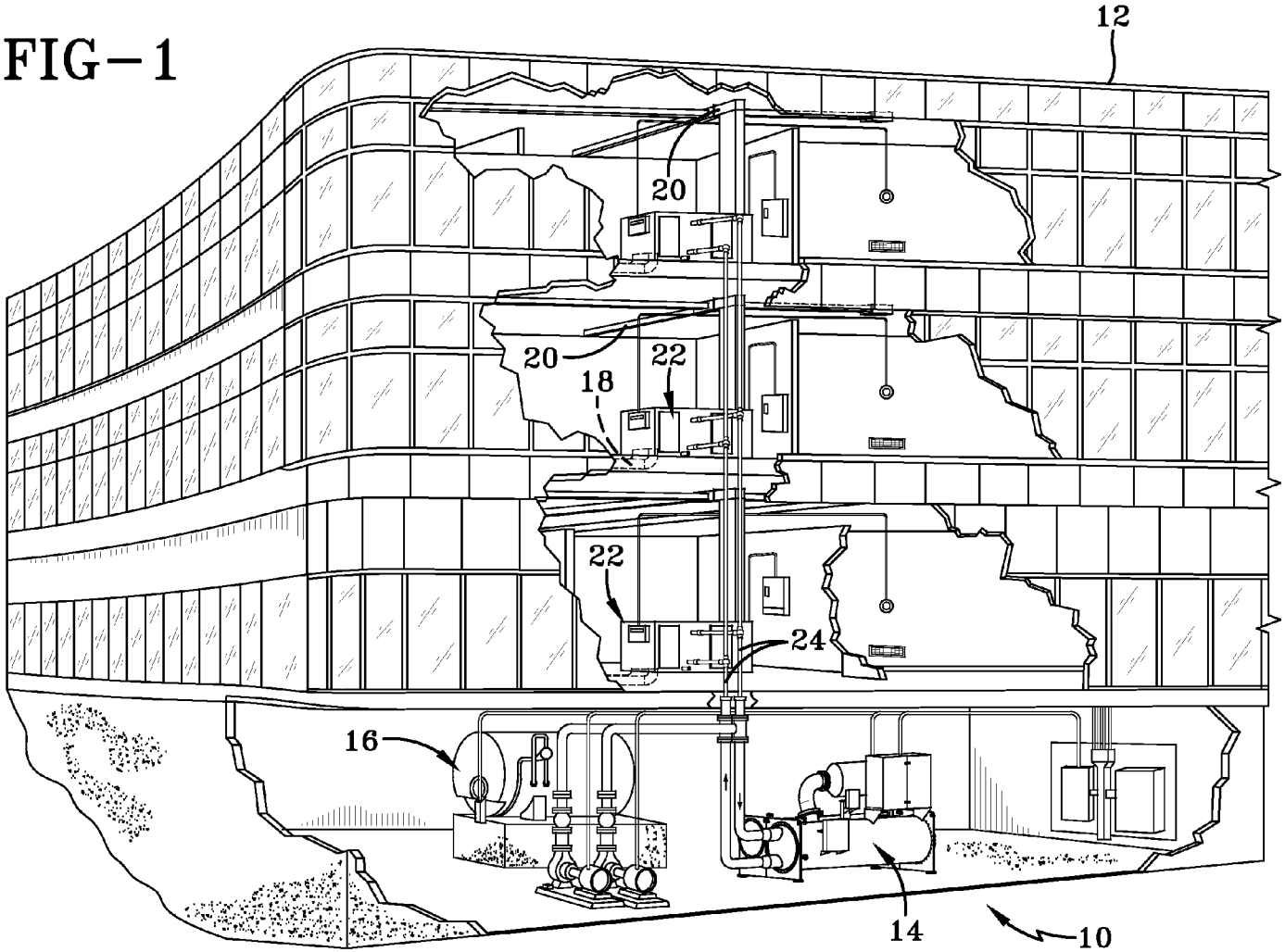
FIG. 1 shows an exemplary embodiment for a heating, ventilation and air conditioning system.

FIG. 1 shows an exemplary environment for a heating, ventilation and air conditioning (HVAC) system 10 in a building 12 for a typical commercial setting. System 10 can include a vapor compression system 14 that can supply a chilled liquid which may be used to cool building 12. System 10 can include a boiler 16 to supply a heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
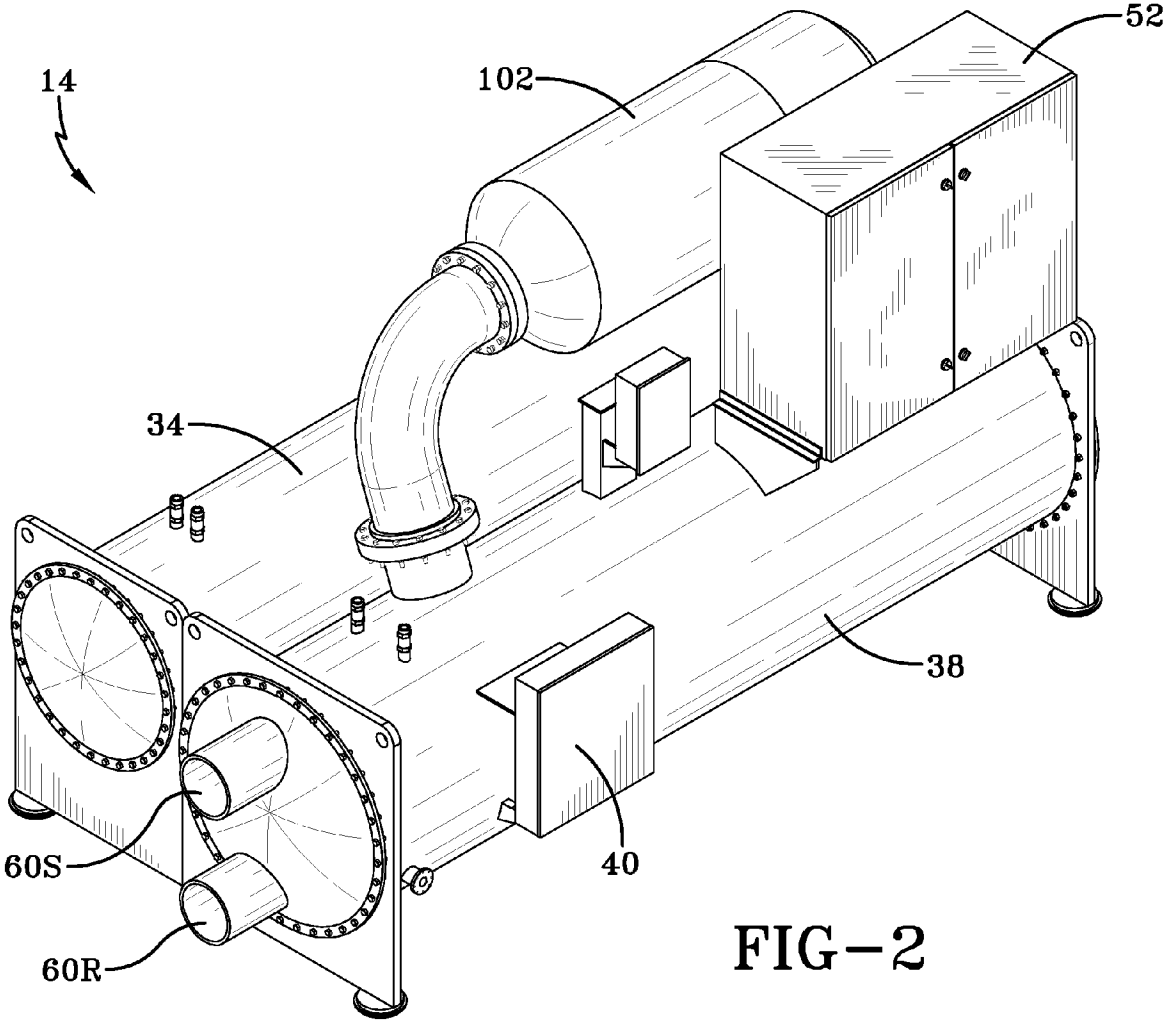
FIG. 2 shows an isometric view of an exemplary vapor compression system.
Figure 3:
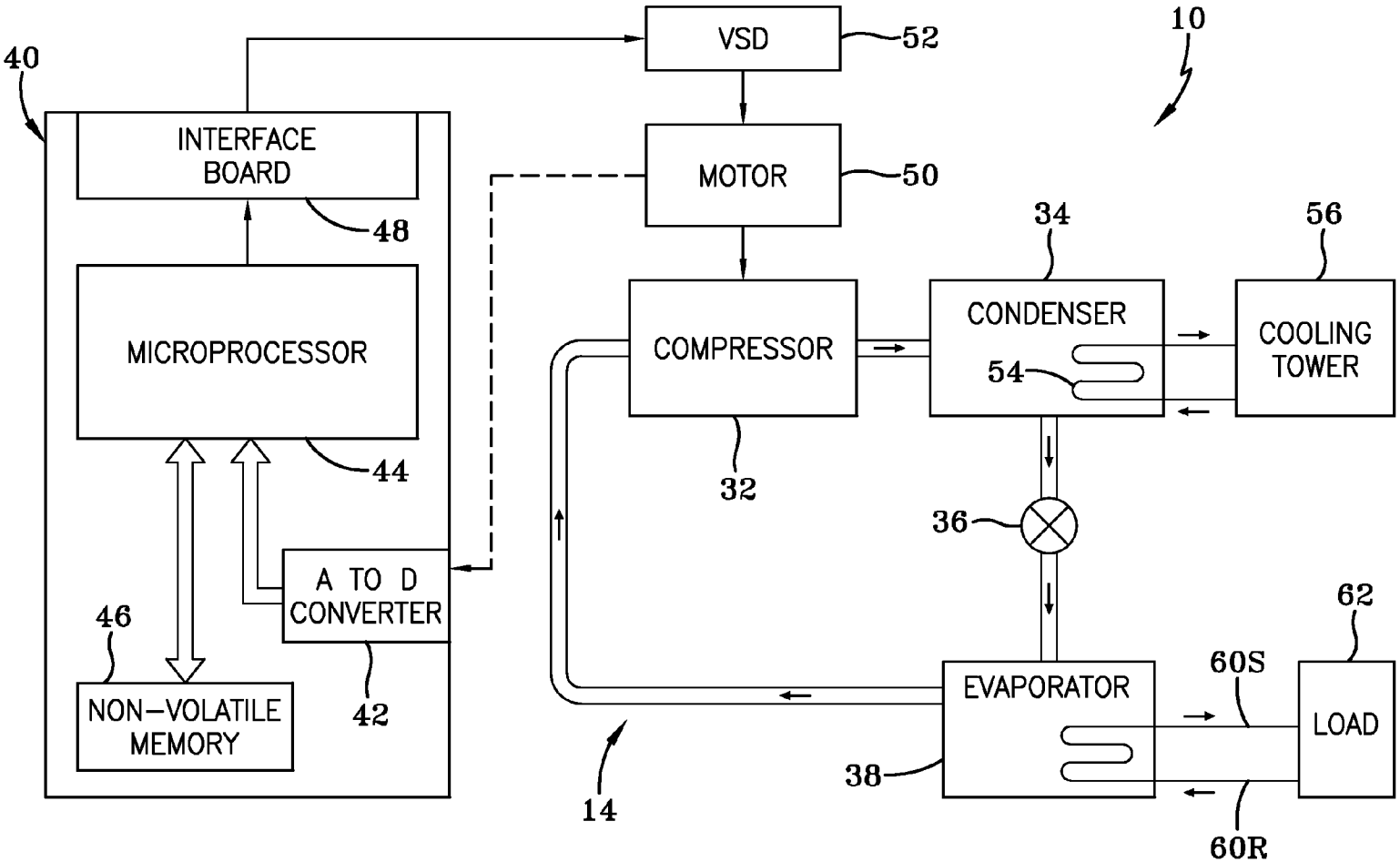
FIGS. 3 and 4 schematically show exemplary embodiments of vapor compression systems.

FIGS. 2 and 3 show an exemplary vapor compression system 14 that can be used in HVAC system 10. Vapor compression system 14 can circulate a refrigerant through a circuit starting with compressor 32 and including a condenser 34, expansion device(s) 36, and an evaporator or liquid chiller 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of variable speed drives (VSDs) 52, motors 50, compressors 32, condensers 34, expansion valves 36 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. Motor 50 can be any other suitable motor type, for example, a switched reluctance motor, an induction motor, or an electronically commutated permanent magnet motor.

Compressor 32 compresses a refrigerant vapor and delivers the vapor to condenser 34 through a discharge passage. Compressor 32 can be a screw compressor in one exemplary embodiment. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
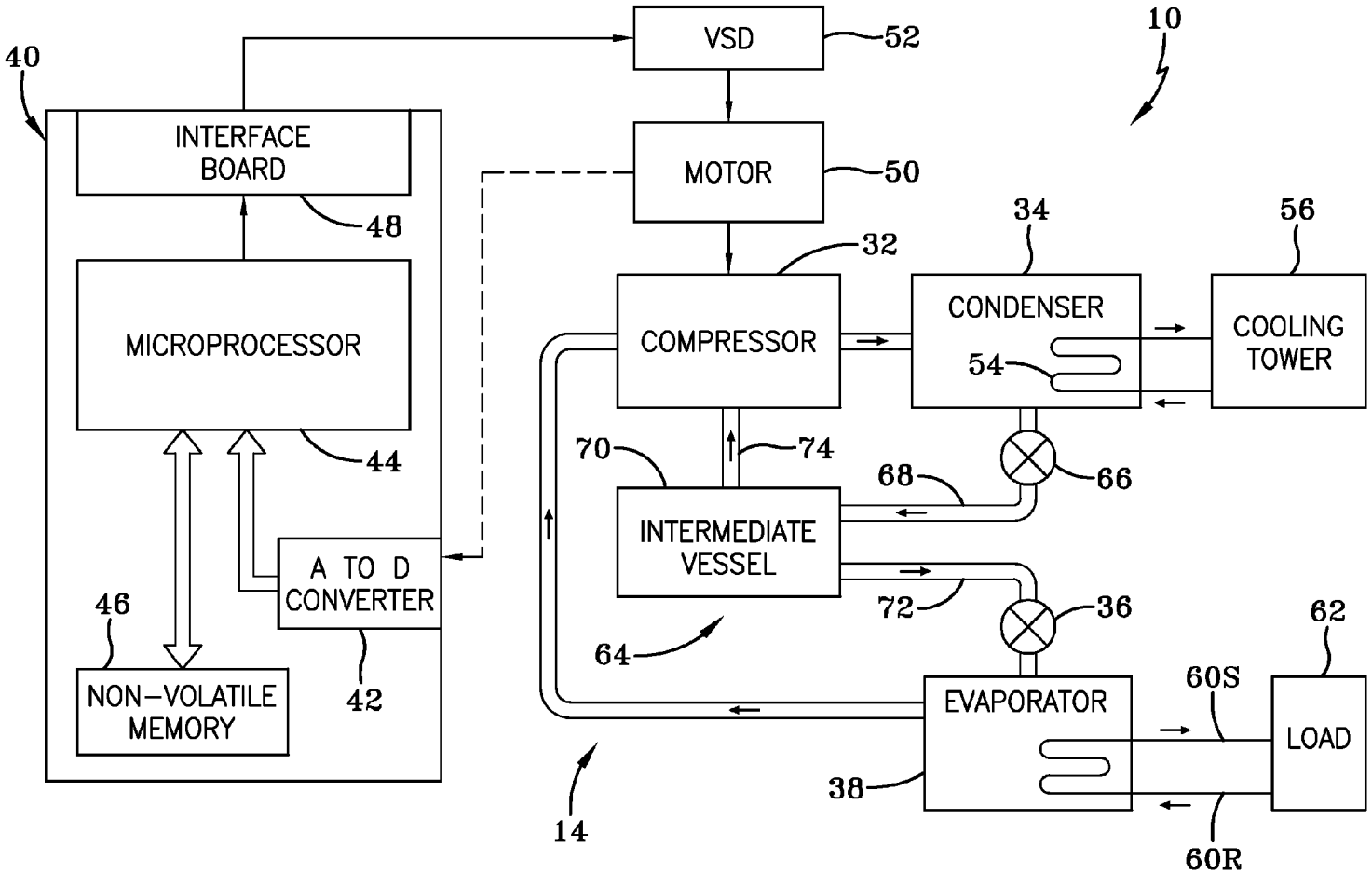
Figure 5:
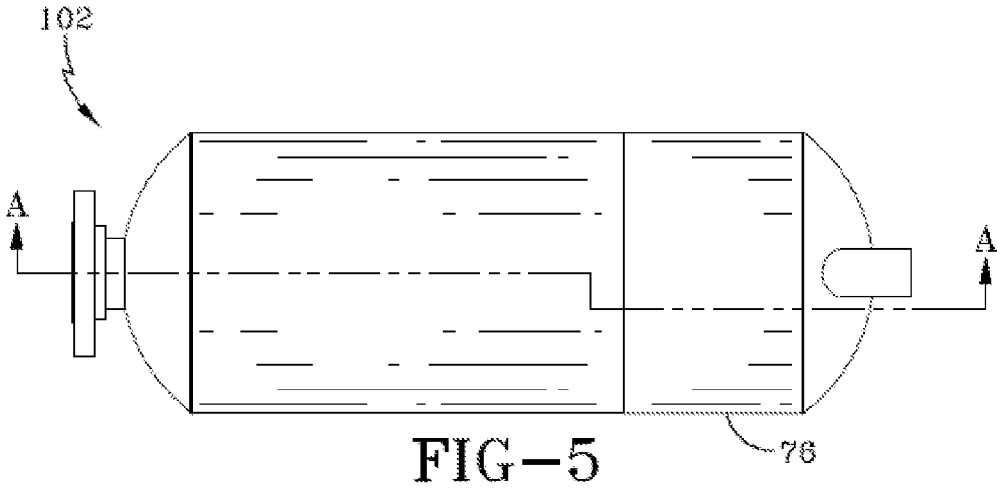
FIG. 5 shows a plan view of an exemplary embodiment of a compressor.
Figure 6:
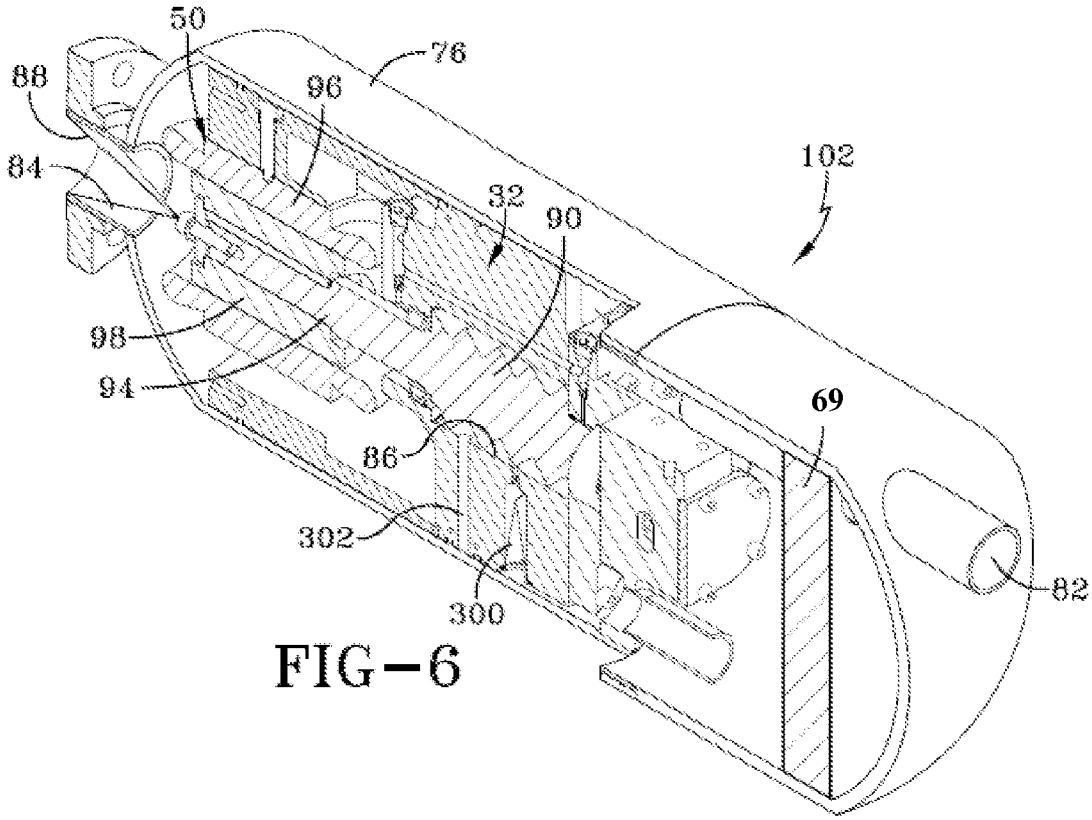
FIG. 6 shows a perspective cross-sectional view taken along line A-A of the compressor of FIG. 5.
Figure 7:
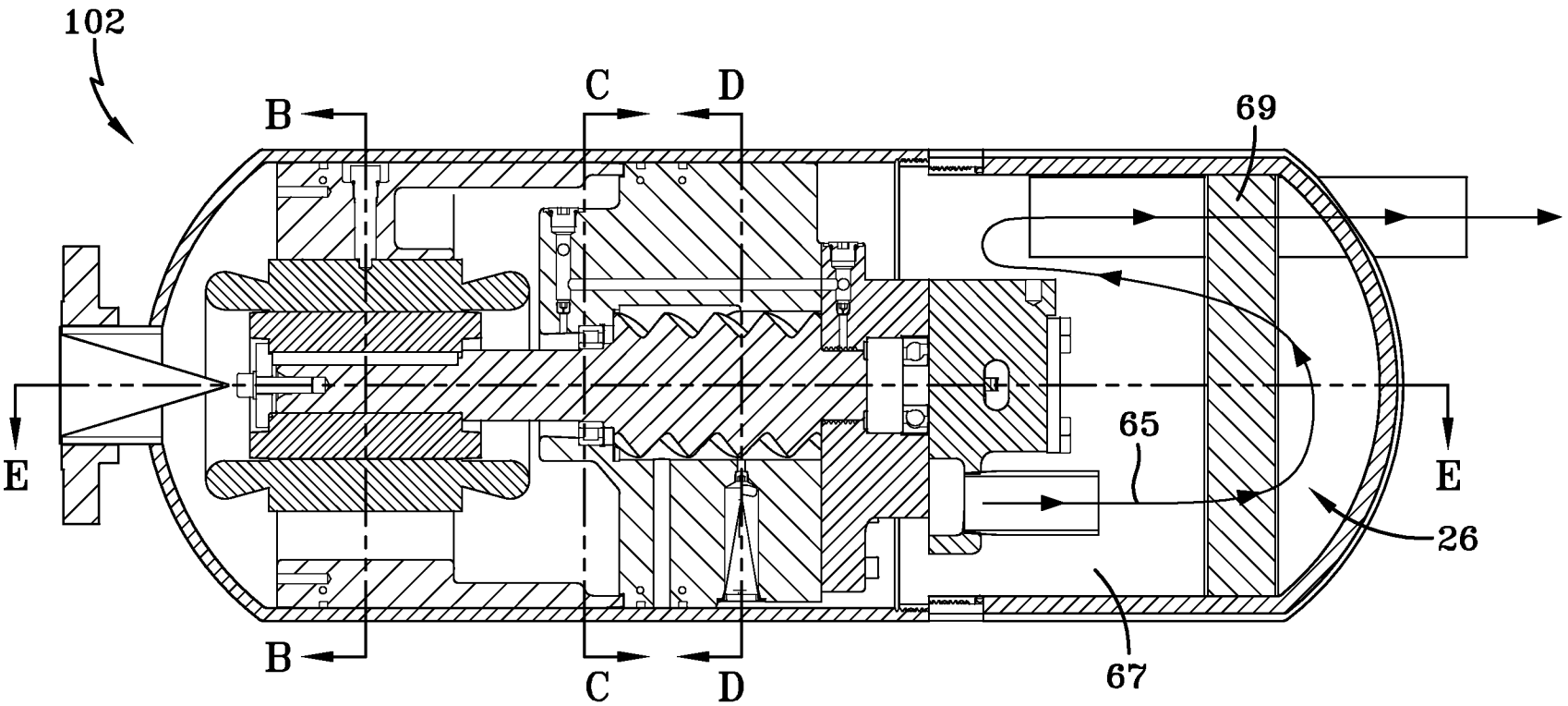
FIG. 7 shows a side cross-sectional view taken along line A-A of the compressor of FIG. 5.
Figure 8:
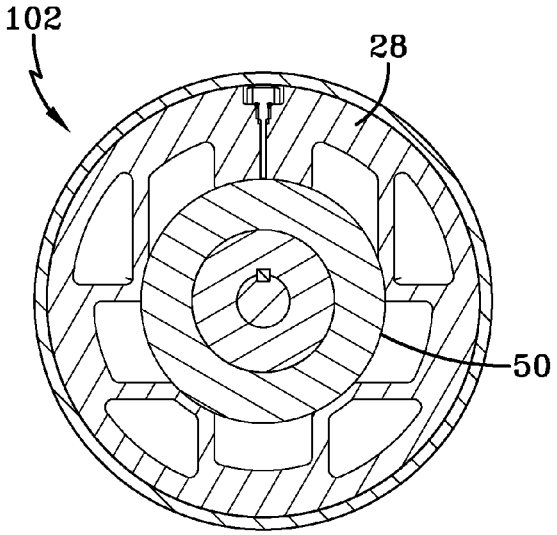
FIG. 8 shows a cross-sectional view taken along line B-B of the compressor of FIG. 7.
Figure 9:
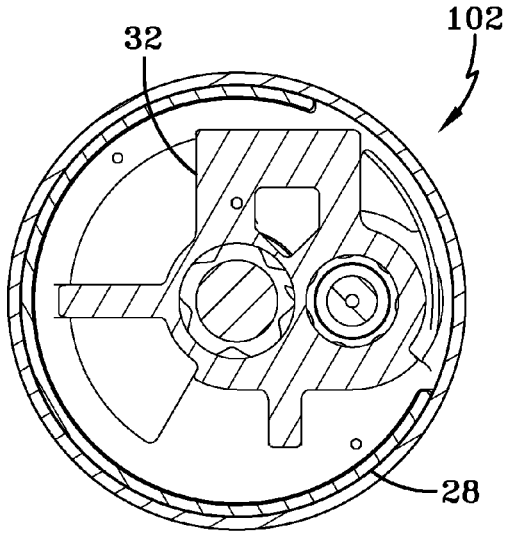
FIG. 9 shows a cross-sectional view taken along line C-C of the compressor of FIG. 7.
Figure 10:
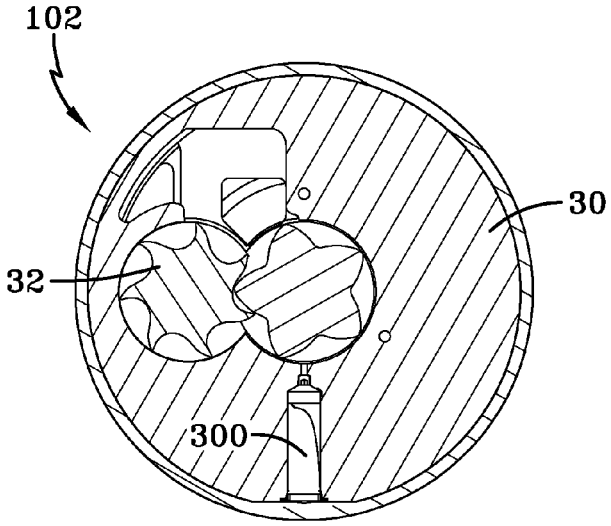
FIG. 10 shows a cross-sectional view taken along line D-D of the compressor of FIG. 7.
Figure 11:
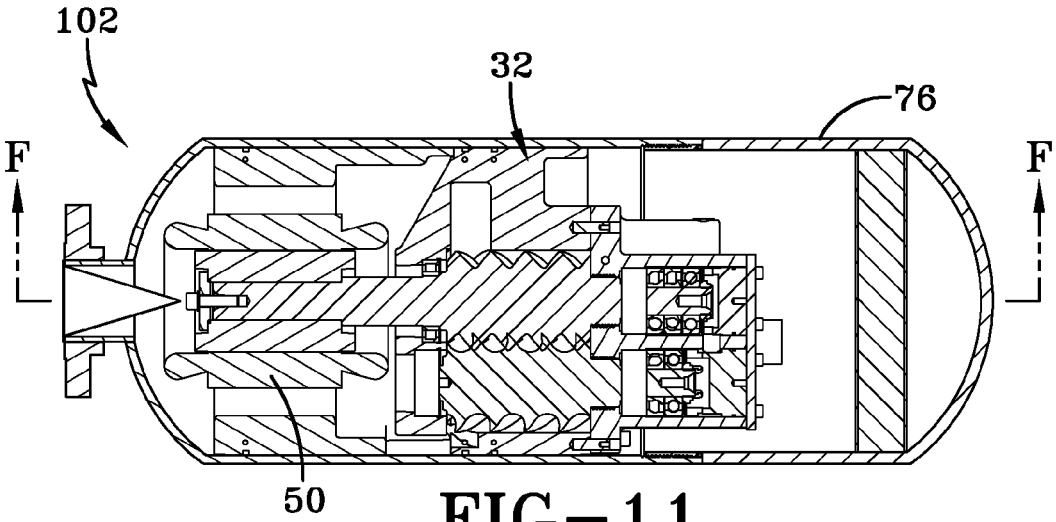
FIG. 11 shows a cross-sectional view taken along line E-E of the compressor of FIG. 7.
Figure 12:
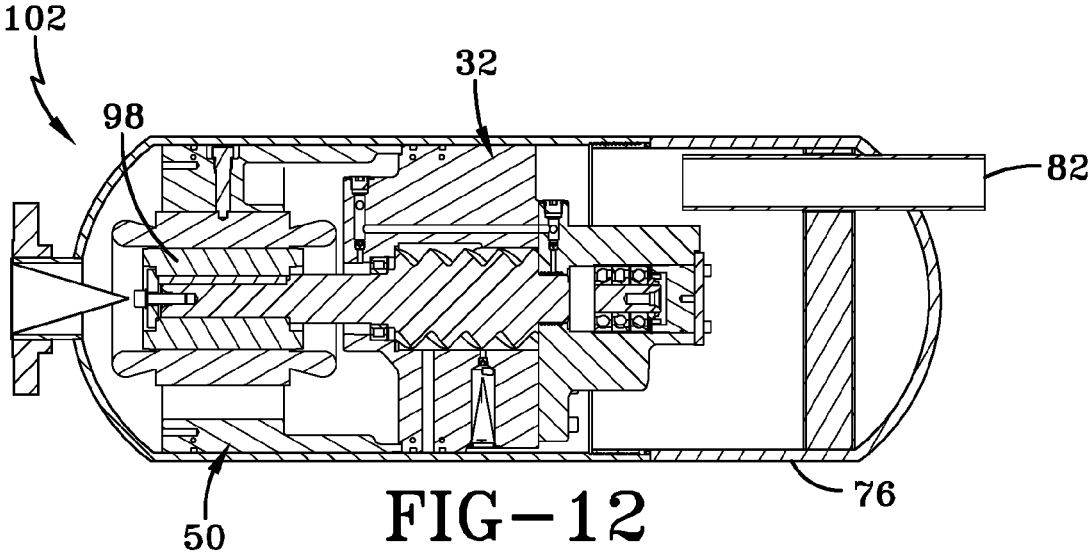
FIG. 12 shows a cross-sectional view taken along line F-F of the compressor of FIG. 11.
Figure 13:
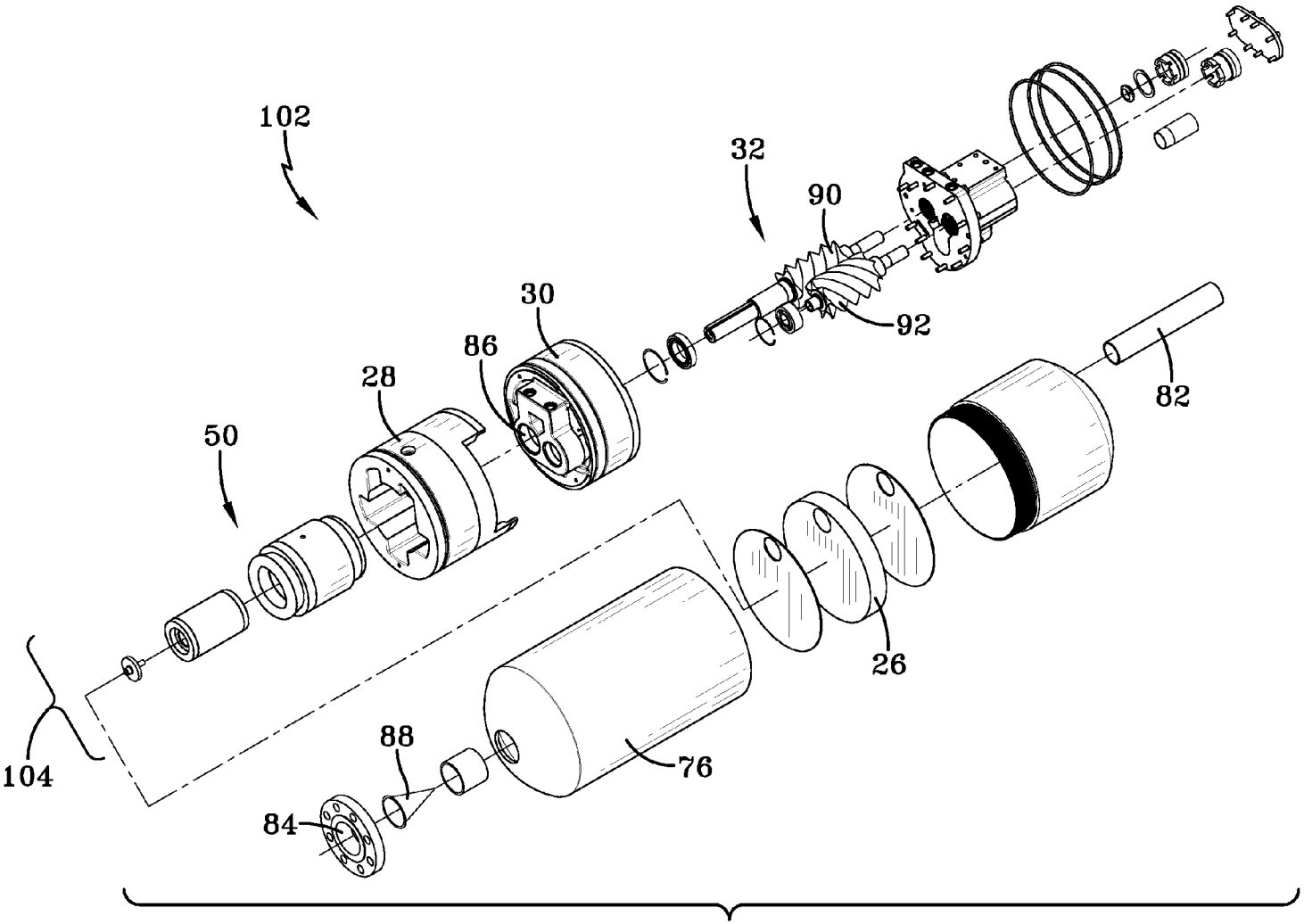
FIG. 13 shows an exploded perspective view of the compressor of FIG. 5.
Figure 14:
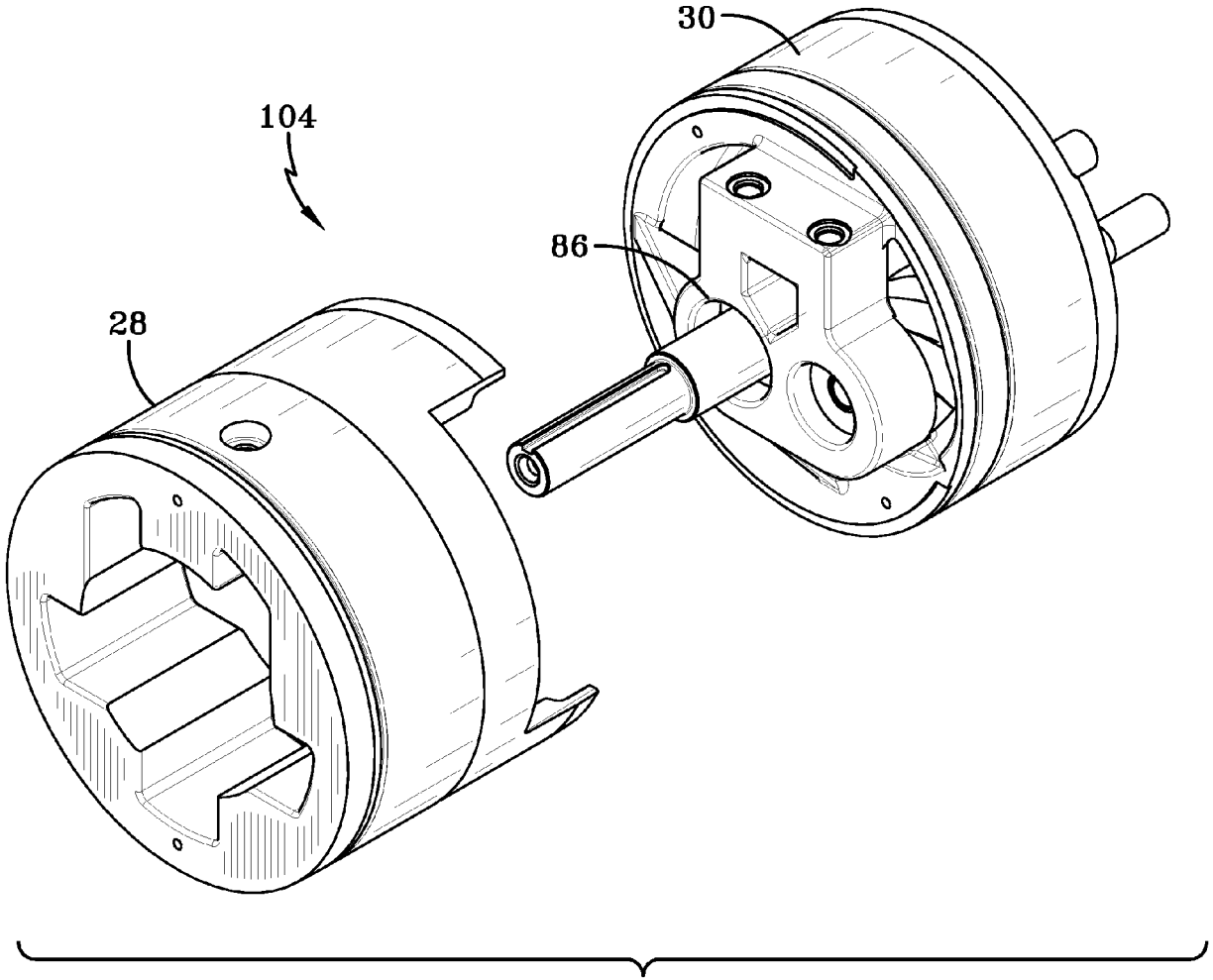
FIG. 14 shows an exploded perspective view of the motor housing and compressor housing of the compressor of FIG. 5.
Figure 16:
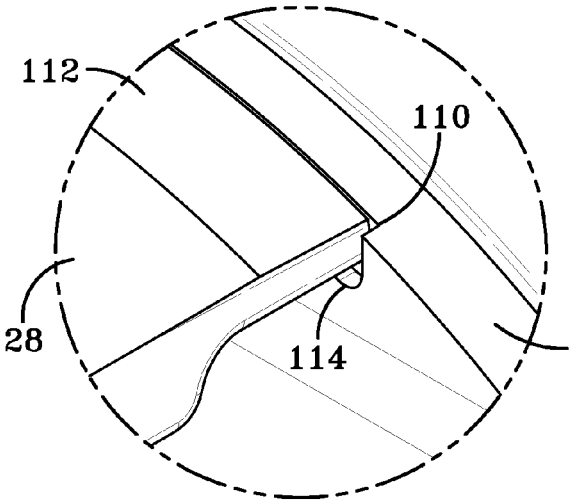
FIG. 16 shows an enlarged region of the motor housing and compressor housing of FIG. 15.
Figure 15:
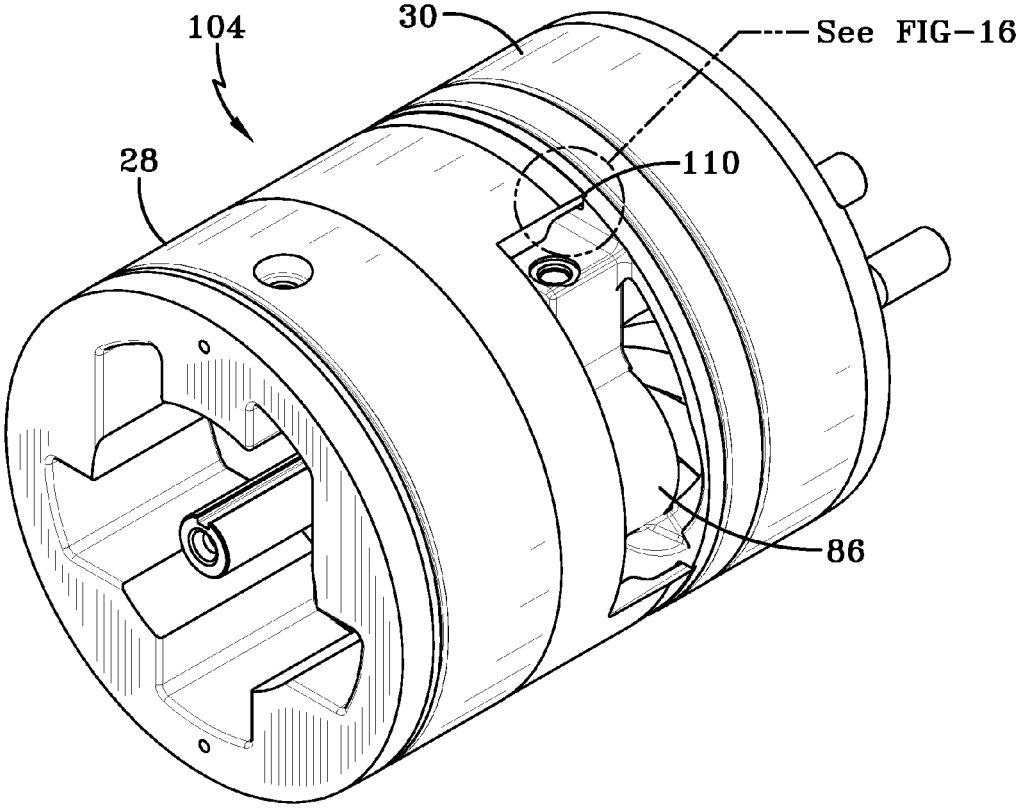
FIG. 15 shows a perspective view of the motor housing and compressor housing of the compressor of FIG. 5 assembled to each other.

FIG. 4, which is similar to FIG. 3, shows the vapor compression system 14 with an intermediate circuit 64 incorporated between condenser 34 and expansion device 36. Intermediate circuit 64 has an inlet line 68 that can be either connected directly to or can be in fluid communication with condenser 34. As shown, inlet line 68 includes an expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer." In the configuration shown in FIG. 4, i.e., the intermediate vessel 70 is used as a flash tank, a first expansion device 66 operates to lower the pressure of the liquid received from condenser 34. During the expansion process, a portion of the liquid vaporizes. Intermediate vessel 70 may be used to separate the vapor from the liquid received from first expansion device 66 and may also permit further expansion of the liquid. The vapor may be drawn by compressor 32 from intermediate vessel 70 through a line 74 to the suction inlet, a port at a pressure intermediate between suction and discharge or an intermediate stage of compression. The liquid that collects in the intermediate vessel 70 is at a lower enthalpy from the expansion process. The liquid from intermediate vessel 70 flows in line 72 through a second expansion device 36 to evaporator 38.

FIGS. 5-16 show an exemplary embodiment of a compressor. Compressor 102 includes a housing 76 that contains the working parts of compression mechanism 32, motor 50, and oil separator 26. In an exemplary embodiment, housing 76 can have a substantially cylindrical shape and be made of two or more portions that are connected together by any suitable technique to form a hermetic seal.

Vapor can be directed to an intake passage 84 of compressor 102 then to a suction inlet (not shown) of compression mechanism 32. In an exemplary embodiment, vapor may flow through a filter 88 to the suction inlet. In another exemplary embodiment, the vapor flowing from intake passage 84 to the suction inlet of compression mechanism 32 can be used to cool motor 50.

As vapor flows through the suction inlet, a male rotor 90 driven by motor 50 rotates while matingly engaging a female rotor 92 with intermeshing lands and grooves. Rotors 90, 92 each rotate in a cylinder 86 within compression mechanism 32. The vapor enters compression pockets defined between the surfaces of the rotors of compression mechanism 32. As the rotors of compression mechanism 32 engage one another, the compression pockets between the rotors of compression mechanism 32, also referred to as lobes, are reduced in size and are axially displaced to a discharge side of compression mechanism 32. The compressed vapor from compression mechanism 32 can be discharged to oil separator 26 and can then exit compressor 102 through discharge passage 82.

Motor 50 can be connected to male rotor 90 of compression mechanism 32 by a drive shaft 94. Motor 50 can include a stator 96 and a rotor 98 configured to rotate drive shaft 94 thereby driving or rotating male rotor 90 and female rotor 92. In one exemplary embodiment, motor 50 can be powered by VSD 52 that can vary the speed of motor 50 and thereby vary the speed and capacity of compression mechanism 32. VSD 52 can provide power to motor 50 through the use of a terminal connection in housing 76 which enable power to be provided to the motor through the housing. In another exemplary embodiment, compression mechanism 32 may use a slide valve for capacity control.

Oil separator 26 can remove entrained oil from the compressed vapor prior to the compressed vapor being provided to discharge passage 82. In an exemplary embodiment, oil separator 26 can remove the entrained oil from compressed vapor by forcing the vapor to travel or flow through a tortuous path 65 having several changes of direction for the vapor flow to remove the entrained oil. In addition, a filter 69, for example, a mesh pad, can be placed in oil separator 26 to assist in the removal of entrained oil. In an exemplary embodiment, the compressed vapor can be forced to flow through the filter several times to remove entrained oil before the compressed vapor is permitted to flow into discharge passage 82. The entrained oil removed from the compressed vapor can flow into an oil sump 67 located at the bottom of housing 76 wherein the oil can be recirculated to compression mechanism 32 and other internal components requiring lubrication. In one exemplary embodiment, a passageway 300 (see FIG. 10) can be used to circulate oil to the compression mechanism 32. A strainer can be incorporated into passageway 300 to remove any particles or debris that may be in the oil before the oil reaches the compression mechanism 32.

Referring to FIGS. 13-16, motor 50 can be placed or positioned in a motor housing 28 and compression mechanism 32 can be placed or positioned in a compressor housing 30. Motor housing 28 and compressor housing 30 can then be placed or positioned in housing 76. In an exemplary embodiment, motor housing 28 and compressor housing 30 can each have a substantially cylindrical shape designed to fit into housing 76. In an exemplary embodiment, after motor 50 is assembled in motor housing 28 and compression mechanism 32 is assembled in compressor housing 30, motor housing 28 and compression housing 30 are connected or secured to each other to form a first portion 104 of compressor 102. In one exemplary embodiment, motor housing 28 and compressor housing 30 can be connected by an interlock connection 110 to prevent relative rotational movement of motor housing 28 and compressor housing 30. Interlock connection 110 can be made by a protrusion 112 of motor housing 28 fitting or being inserted into a groove or notch 114 of compressor housing 30. In another exemplary embodiment, compressor housing 30 may have a protrusion and motor housing 28 may a corresponding groove or notch. In still another exemplary embodiment, motor housing 28 may have multiple protrusions and compressor housing 30 may have multiple grooves. However, in other exemplary embodiments, any suitable connection technique such as friction fit, threading, grooves, alignment mechanisms, other suitable securing mechanism, or combinations thereof may be used between compressor housing 30 and motor housing 28 to prevent relative rotational movement.

In an exemplary embodiment, first portion 104, i.e., motor housing 28 and compressor housing 30, can be held in housing 76 by an interference or friction connection or other suitable connection technique to prevent or substantially limit axial movement of the motor housing 28 and compressor housing 30. Housing 76 can be used to align and support motor housing 28 and compressor housing 30. Since both motor housing 28 and compressor housing 30 are held in housing 76 by an interference connection, housing 76 maintains the alignment of motor housing 28 and compressor housing 30 by preventing relative radial movement of the motor housing 28 and compressor housing 30. Similarly, the interference connection of motor housing 28 and compressor housing 30 in housing 76 permit housing 76 to distribute the weight of the motor housing 28 and compressor housing 30 and provide support for motor housing 28 and compressor housing 30 without additional support mechanisms. In other exemplary embodiments, first portion 104 may be secured to housing 76 by a friction fit, threading, grooves, alignment mechanisms, welding, interlock 110, other suitable securing mechanisms, or combinations thereof.

Figure 17:
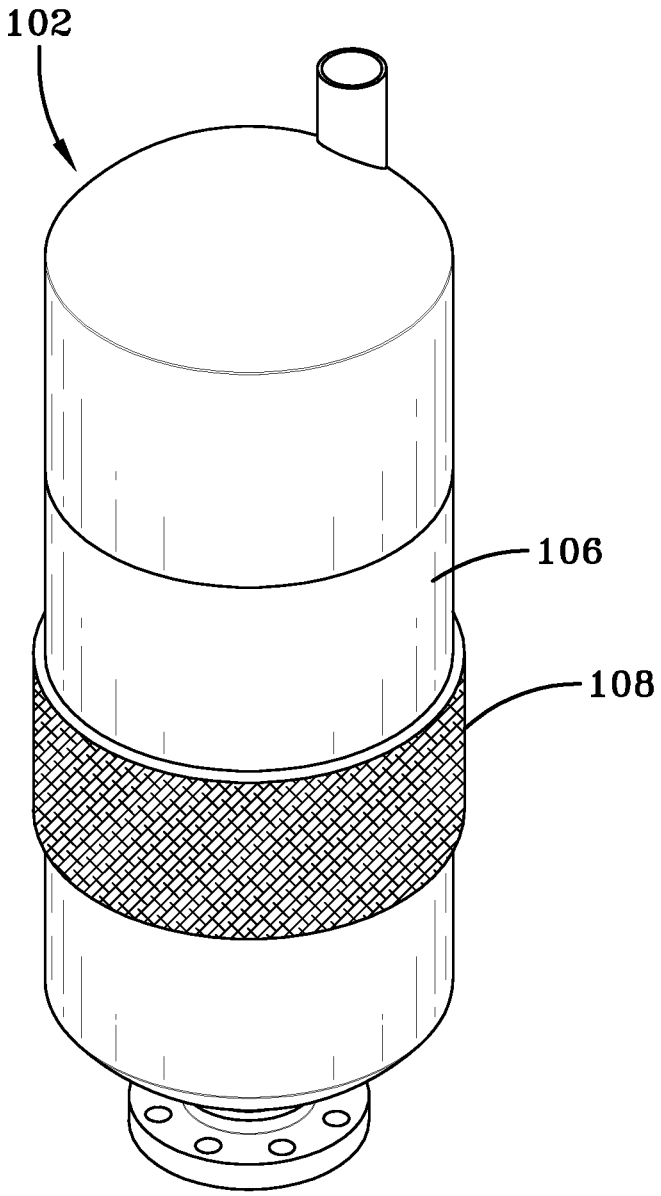
FIG. 17 shows an exemplary embodiment of assembling a compressor with a band heater.

Referring to FIG. 17, in an exemplary embodiment, compressor 102 can be assembled by expanding the circumference and diameter of a steel cylinder 106, which can be part of housing 76, to enable motor housing 28 and compressor housing 30 to be positioned within steel cylinder 106. In one exemplary embodiment, steel cylinder 106 may be expanded by heating steel cylinder 106 with a suitable heater, for example, a band heater 108. As steel cylinder 106 cools, the circumference and diameter of steel cylinder 106 contract to form fit or shrink fit around motor housing 28 and compressor housing 30. A friction or interference connection between motor housing 28 and compressor housing 30 and housing 76 is formed to prevent axial movement. After all of the components of compressor 102 are inserted and/or connected into steel cylinder 106, steel cylinder 106 can be sealed using one or more additional shell portions to form housing 76. By utilizing steel cylinder 106, the maximum operating pressure inside of housing 76 may be increased due to the stability and strength provided by the cylindrical shape and the use of steel. Increasing the maximum operating pressure for compressor 102 may permit the use of refrigerants that operate under higher pressure conditions. For example, an increase in the maximum operating pressure may permit R-410A to be used in a larger quantity in compressor 102 without an increased risk of seepage through seals.

In an exemplary embodiment, suitable fasteners, for example, cast features integral with motor housing 28 and compressor housing 30 can interlock thereby securing motor housing 28 and compressor housing 30 together. In this embodiment, housing 76 may permit cast features and/or casings for motor housing 28 and compressor housing 30 to be less complex due to housing 76 being cylindrical in shape and being sealed. The reduction of the complexity of cast features and/or casings for motor housing 28 and compressor housing 30 may result in decreased labor time in manufacturing the cast features and/or casings. For example, the cast features and/or casings may be incorporated in small pancake-like or cylindrical castings that can fit into automated molding and casting lines instead of requiring individual manual fabrication. The cast features and/or casings may be manufactured by other suitable techniques, for example, by using flexible machining centers or automated molding techniques, in addition to horizontal bore mills.

In another exemplary embodiment, a connection for an economizer circuit can be included in housing 76 and compressor housing 32 can be designed to include a passageway 302 (see FIG. 6) from the economizer circuit connection to cylinder 86 in compression mechanism 32. In one exemplary embodiment, a pair of axially spaced seals or o-rings can be positioned between housing 76 and compressor housing 32. The opening to passageway 302 in compressor housing 32 can be positioned between the pair of o-rings. By placing the opening to passageway 302 between the o-rings, a circumferential channel is formed between housing 76 and compressor housing 32. The presence of the circumferential channel permits the economizer connection in housing 76 to be positioned at any circumferential position on housing 76 that is in fluid communication with the channel. In a further exemplary embodiment, the circumferential channel can include a corresponding annular groove in compressor housing 32 to provide additional space for fluid flow from the economizer circuit connection.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

a first housing, the first housing having a first end with an intake passage and a second end opposite the first end with a discharge passage, a direction of fluid flow through the intake passage is substantially parallel to a direction of fluid flow through the discharge passage;

a second housing held in the first housing by an interference connection to limit axial movement of the second housing;

a motor positioned in the second housing;

a third housing held in the first housing by an interference connection to limit axial movement of the third housing;

a compression mechanism positioned in the third housing; and the second housing being connected to the third housing to prevent relative rotational movement between the second housing and the third housing.

2. The compressor of claim 1 wherein the connection between the second housing and the third housing is an interlocking connection.

3. The compressor of claim 2 wherein the interlocking connection comprises a protrusion and a groove, and insertion of the protrusion into the groove forms the interlocking connection.

4. The compressor of claim 3 wherein the second housing comprises the protrusion and the third housing comprises the groove.

5. The compressor of claim 4 wherein the protrusion is integral with the second housing and the groove is integral with the third housing.

6. The compressor of claim 1 wherein the second housing has a substantially cylindrical shape.

7. The compressor of claim 1 wherein the third housing has a substantially cylindrical shape.

8. The compressor of claim 1 further comprising an oil separator positioned in the first housing, the oil separator being configured to provide a tortuous path for fluid from the compression mechanism to a discharge port of the first housing.

9. The compressor of claim 8 wherein the oil separator comprises a filter and the tortuous path for fluid passes through the filter more than one time.

10. The compressor of claim 1 wherein the third housing includes a passageway for an economizer circuit connection to the compression mechanism.

11. The compressor of claim 10 wherein the passageway for an economizer circuit connection comprises a groove in the third housing.

12. A compressor comprising:

a substantially cylindrical housing;

a motor housing positioned in the cylindrical housing, the motor housing having a substantially cylindrical shape;

a motor positioned in the motor housing;

a compressor housing positioned in the cylindrical housing, the compressor housing having a substantially cylindrical shape;

a pair of intermeshing rotors positioned in the compressor housing;

the motor housing and the compressor housing being connected to the cylindrical housing with a frictional connection to prevent axial movement of the motor housing and the compressor housing in the cylindrical housing; and the compressor housing having an outlet for compressed vapor, the outlet being positioned opposite the motor housing and being in fluid communication with an interior portion of the cylindrical housing.

13. The compressor of claim 12 wherein the motor housing is connected to the compressor housing to prevent relative rotational movement between the motor housing and the compressor housing.

14. The compressor of claim 13 wherein the connection between the motor housing and the compressor housing is an interlocking connection.

15. The compressor of claim 14 wherein the interlocking connection comprises a protrusion and a groove, and insertion of the protrusion into the groove forms the interlocking connection.

16. The compressor of claim 15 wherein the motor housing comprises the protrusion and the compressor housing comprises the groove.

17. The compressor of claim 16 wherein the protrusion is integral with the motor housing and the groove is integral with the compressor housing.

18. The compressor of claim 12 further comprising an oil separator positioned in the interior portion of the cylindrical housing, the oil separator being configured to provide a tortuous path for fluid from the compression mechanism to a discharge port of the cylindrical housing.

19. The compressor of claim 18 wherein the oil separator comprises a filter and the tortuous path for fluid passes through the filter more than one time.

20. The compressor of claim 12 wherein the compressor housing includes a passageway for an economizer circuit connection to the pair of pair of intermeshing rotors.

* * * * *